United States Patent [19]

Müller

[11] 4,421,142

[45] Dec. 20, 1983

[54] METHOD FOR THE PRODUCTION OF A FABRIC, PARTICULARLY TAPE FABRIC, LOOM FOR THE PERFORMANCE OF THE METHOD AND FABRIC PRODUCED ACCORDING TO THE METHOD

[75] Inventor: Jakob Müller, Stansstad, Switzerland

[73] Assignee: Textilma AG, Hergiswil, Switzerland

[21] Appl. No.: 279,978

[22] PCT Filed: Oct. 30, 1980

[86] PCT No.: PCT/CH80/00131

§ 371 Date: Jun. 22, 1981

§ 102(e) Date: Jun. 22, 1981

[30] Foreign Application Priority Data

Nov. 8, 1979 [CH] Switzerland ..... 9998/79

[51] Int. Cl.[3] ..... D03D 13/00; D03D 47/40

[52] U.S. Cl. ..... 139/117; 139/383 R; 139/430

[58] Field of Search ..... 139/116, 117, 430–432, 139/383 R, 416, 440–442

[56] References Cited

U.S. PATENT DOCUMENTS

| | | | |
|---|---|---|---|
| 1,405,274 | 1/1922 | Campbell et al. | 139/117 |
| 1,763,074 | 6/1930 | Taylor | 139/383 R |
| 3,664,380 | 5/1972 | Haberhauer et al. | 139/116 X |
| 4,181,159 | 1/1980 | Frohlich et al. | 139/116 |
| 4,344,463 | 8/1982 | Muller et al. | 139/117 X |

FOREIGN PATENT DOCUMENTS

| | | | |
|---|---|---|---|
| 126556 | 1/1902 | Fed. Rep. of Germany | 139/383 R |
| 256390 | 8/1926 | United Kingdom | 139/117 |

*Primary Examiner*—James Kee Chi

*Attorney, Agent, or Firm*—Werner W. Kleeman

[57] ABSTRACT

In the method for the production of a fabric, particularly tape fabric, two weft thread loops formed from different weft threads are laid into a shed formed of warp threads and bound off without use of an auxiliary thread. This is made possible thereby, that at least one weft thread is guided into the shed through a tooth gap of the reed.

13 Claims, 4 Drawing Figures

METHOD FOR THE PRODUCTION OF A FABRIC, PARTICULARLY TAPE FABRIC, LOOM FOR THE PERFORMANCE OF THE METHOD AND FABRIC PRODUCED ACCORDING TO THE METHOD

BACKGROUND OF THE INVENTION

The invention concerns a method for the production of a fabric, particularly tape fabric, a loom for the performance of the method and a fabric produced according to the method.

A method for the production of a tape fabric has become known from the German Pat. No. 1,804,973, in which weft thread loops are carried in from both sides of a warp shed and connected by means of an auxiliary thread in the middle of the tape fabric. In that case, the auxiliary thread is drawn each time through the weft thread loop by means of a weaving needle effective perpendicularly to the tape plane and woven with itself at one side of the tape fabric.

Such a tape fabric produced according to the described method displays in its middle a thickening row of stitches, which is disadvantageous not only optically, but the exposed small stitch members of the auxiliary thread can also be easily damaged or destroyed, which has the consequence of the dissolution of the tape fabric.

SUMMARY OF THE INVENTION

It is an important object of the invention to develop a method and a loom for the production of a tape fabric, in which the weft thread loops are connected with one another within the width of the fabric without an auxiliary thread being needed and without danger of a dissolution of the tape fabric existing.

Now in order to implement this object and others which will become more readily apparent as the description proceeds, the inventive method of weaving a fabric, particularly a tape fabric, comprises the steps of laying into a shed formed of warp threads at least two weft threads by means of weft thread introducing organs arranged laterally of the shed, at least one weft thread being fed, prestored according to programme, to the shed through one of the tooth gaps provided in a reed for the passage of the warp threads. The weft threads are then formed into loops which are laid in substantially parallel to the fabric beating edge, the loops are connected with one another within the width of the fabric between two adjacent warp threads by crossing the sides of a loop with the respective sides of the other loop, while for the formation of a fabric edge from said at least one weft thread fed through the reed, said thread is looped with itself or held by means of at least one auxiliary thread.

As to the loom for practicing the method, there is taught a loom, particularly a tape loom, which comprises feed means for programmed prestored feeding of at least two weft threads into a shed formed of warp threads passing through the respective tooth gaps of a loom reed, said feed means being provided with at least two weft thread guides, at least one of which is arranged upstream of the loom reed for guiding one of said two weft threads through one of the loom reed gaps, at least two weft thread introducing organs arranged laterally to the shed in the plane of the fabric being woven and so reciprocable across the shed in the machine rhythm to form said at least two weft threads into loops connected together within the width of the fabric, and at least one knitting tool reciprocable in the machine rhythm for forming an edge of the fabric from said one weft thread guided through the loom reed.

By the method according to the invention, it now becomes possible for the first time to produce a fabric consisting of two weft thread loops free of ladders without use of an auxiliary thread. A fabric can thus be produced with minimum material effort. After the weft threads have been fastened and processed in the fabric, the fabric can no longer be dissolved. Through the weft thread feeding prestored to a program, a fabric of desired density can be produced. Through the simple introduction of the weft threads, a great increase in performance is also made possible in the production of the fabric.

In case auxiliary threads shall be used for the production of the fabric edge, for example for ornamental purposes, this also lets itself be performed readily. Furthermore, three or more weft thread loops can also be introduced into the fabric. By selecting a weft thread from several threads of different colours or appearance, an extra-ordinary pattern variety can also be obtained. When the weft threads in a tape fabric are connected with one another only by sections in fabric direction, openings can be obtained, for example for buttons. Although the method according to the invention appears predestined for a tape fabric, it can also be used to advantage for any other fabric.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
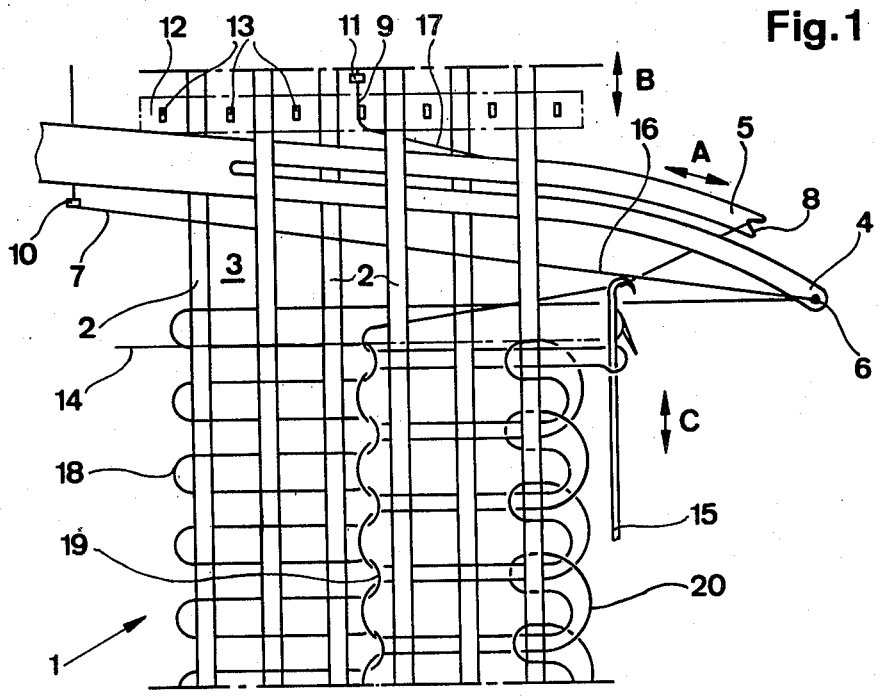
FIG. 1 illustrates a tape loom for the production of a tape fabric formed of two weft threads.

In the tape loom according to FIG. 1, only the parts essential for an understanding of the invention have been illustrated purely schematically, all remaining parts being omitted. A finished woven tape is designated by 1 and warp threads by 2. The warp threads 2 are raised and lowered alternatingly in the machine rhythm or cycle by means of not illustrated, known means of the machine drive and in that case form a shed 3. Two weft thread introducing organs or elements 4 and 5, which are constructed in one piece, are moved together into and out of the shed 3 in direction A in the machine rhythm by the not illustrated machine drive. The weft thread introducing organ 4 at its end displays an eyelet 6 for the guidance of a weft thread 7, while the weft thread introducing organ 5 at its end displays an open thread guide 8 for the guidance of a weft thread 9. The weft thread introducing organs 4 and 5 could also be executed separately, each being drivable on its own. Both weft thread introducing organs 4 and 5 can also display at the end an open or closed or, if desired, an open and a closed thread guide.

Two thread guide organs, which are constructed as desired as known thread guides 10 and 11, are parts of a not further shown device which serves for the feeding, prestored to program, of the weft threads 7 and 9. A reed 12 with bars 13 is movable to and fro in direction B in the machine rhythm for the beating of the weft threads 7 and 9 against the fabric beating edge 14. On the side lying opposite to the drive side of the weft thread introducing organs 4 and 5, a weaving needle or knitting tool 15 is movable to and fro in direction C in the machine rhythm in known manner.

In operation of the loom, the weft thread 7 now gets through the thread guide 10 from externally of the warp threads 2 into the shed 3, while the weft thread 9 is guided into the shed 3 through a tooth gap in the middle of the reed 12 by the thread guide 11 in front of the reed 12. During the weft insertion on each cyclic change of the shed 3 into the end setting, shown in FIG. 1, of the weft thread introducing organs 4 and 5 guiding the weft threads 7 and 9, two weft thread loops 16 and 17 approximately parallel to the fabric beating edge 14 are formed each time. In that case, the weft thread loop 16 of the thread 7 extends over the entire width of the shed, while the weft thread loop 17 extends only over half the width of the shed.

On each weft insertion, the weft thread 7 coming from externally of the shed 3 is guided alternatingly below and above the outermost warp thread 2, whereby the lefthand fabric edge 18 is formed. Through the co-operation of the thread guides 6 and 8 of the weft thread introducing organs 4 and 5, the weft thread loop 17 is guided through the weft thread loop 16 on each weft insertion controlled by the machine drive, whereby the loop connection 19 is formed in the centre of the fabric tape. On each weft insertion, the weaving needle 15 also catches the weft thread 9 for looping with itself, whereby the righthand fabric edge 20 is formed. After each return of the weft thread introducing organs 4 and 5 into the initial setting on the drive side, the reed 12 beats the last inserted weft thread loops 16 and 17 against the fabric edge 14 so that the lefthand fabric half is formed by the weft thread 7 and the righthand fabric half by the weft thread 9.

In the described manner, a tape fabric is obtained, which is unobjectionably looped without protruding edge within the width of the fabric without use of an auxiliary thread. By the weft thread being fed prestored to program, any desired weft thread length can be allocated to each weft insertion so that every fabric part can be woven as densely as desired. By switching the programming off, a quite normal tape can also be produced. When the weft thread is fed externally of the middle of the reed, the weft thread loops brush different parts of the width of the fabric so that fabric parts of different width can be obtained.

Figure 2:
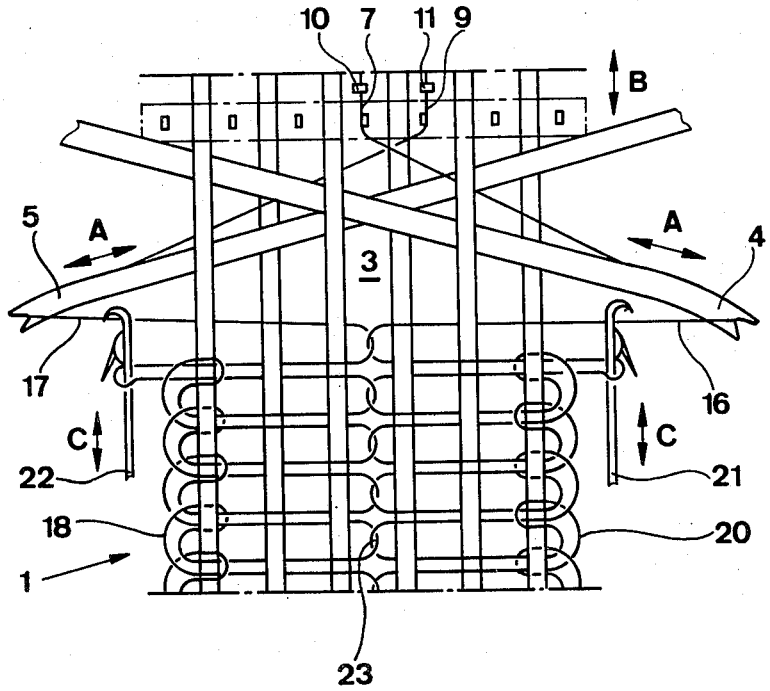
FIG. 2 illustrates a modification of the tape loom illustrated in FIG. 1.

In the tape loom according to FIG. 2, both weft threads 7 and 9 are guided into the shed 3 through a respective tooth gap between th bars 13 of the reed by thread guides 10 and 11 arranged in front of the reed, wherein parts corresponding to the loom in FIG. 1 are provided with like reference numerals. By means of weft thread introducing organs 4 and 5 constructed as push-rods and moving into the shed 3 from each fabric side on each weft insertion, weft thread loops 16 and 17 are formed, which are connected in the middle of the fabric into a cross-connection 23. A weaving needle 21 and 22 respectively seizes the weft thread loops 16 and 17 on each fabric side and loops them together with the weft threads 7 and 9 respectively forming the fabric edge 20 and 18.

Figure 3:
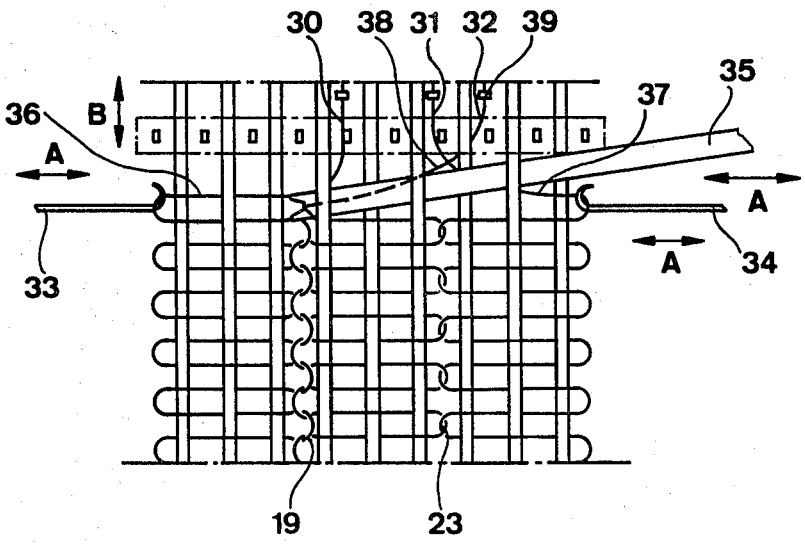
FIG. 3 illustrates a tape loom for the production of a tape fabric formed of three weft threads.

According to FIG. 3, three weft threads 30, 31 and 32 are introduced through a respective tooth gap of the reed into the shed. Acting as weft thread introducing organs are two hooks 33 and 34, which form the weft thread loops 36 and 37 by pulling-out of the weft threads 30 and 31, as well as a push-rod 35, which forms the weft thread loop 38. In this manner, the weft threads 30 and 32 are looped into the loop connection 19 within the tape fabric and the weft threads 31 and 32 are connected into the cross-connection 23. For the formation of the fabric edges, the weft thread loops 36 and 37, respectively, are looped together by means of not illustrated weaving tools with the weft threads 30 and 31 forming the fabric edges, as shown in FIG. 2.

When the thread guide 39 is now for example constructed as part of an equipment which for example consists of three thread guides controllable according to pattern, the weft thread 32 can be selected from three threads of different colour or appearance, while the unselected threads are guided into the fabric with a respective warp thread. In this manner, the middle part of the fabric can be structured as fabric pattern through changing of the weft thread. As a further possibility, the patterned middle part can be extended up to the fabric edges so that the weft threads 30 and 31 only still serve for the formation of the fabric edges.

Figure 4:
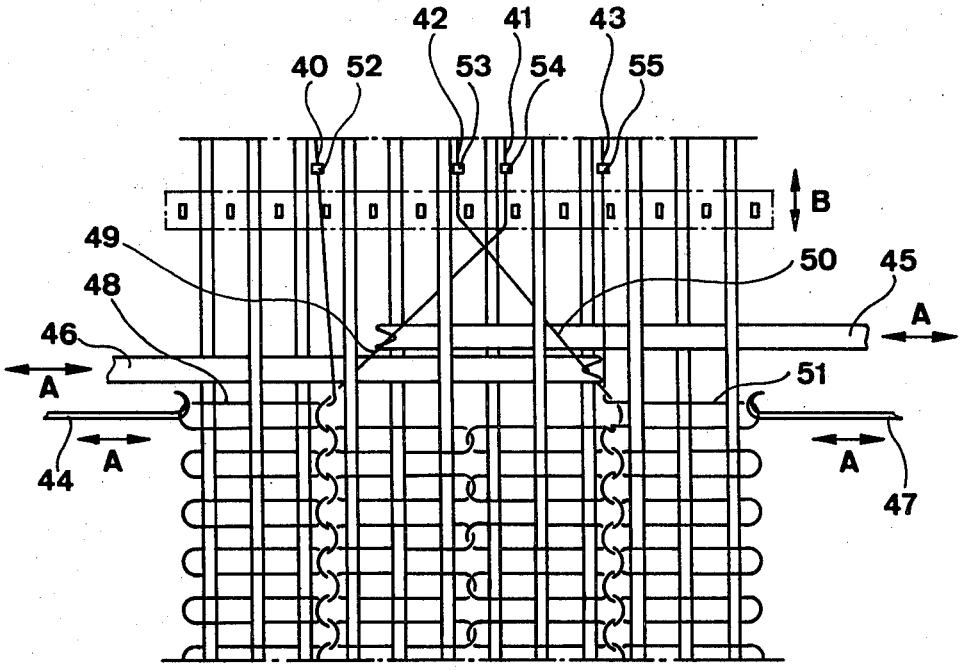
FIG. 4 illustrates a tape loom for the production of a tape fabric formed of four weft threads.

In the example of the FIG. 4, four weft threads 40, 41, 42 and 43 are guided into the shed through a respective tooth gap of the reed. The weft thread loops 48, 49, 50 and 51 are formed by means of weft thread introducing organs 44, 45, 46 and 47 constructed as push rods or hooks. The weft thread loops 48 and 49 as well as 50 and 51 are looped together within the width of the fabric, while 49 and 50 are connected crossed with each other. When one or more thread guide organs 52, 53, 54 and 55 are now constructed as equipment controllable according to pattern, then all feasible pattern possibilities open up for the fabric. Auxiliary threads, which are connected at the edges with the weft thread loops by means of introducing tools controllable in the machine rhythm, can also still be fed externally of the warp threads for the formation of the fabric edges. While there are shown and described present preferred embodiments of the invention, it is to be distinctly understood that the invention is not limited thereto, but may be otherwise variously embodied and practiced within the scope of the following claims.

What I claim is:

1. A method of weaving a fabric, particularly a tape fabric, comprising the steps of:

laying into a shed formed of warp threads at least two weft threads by means of weft thread introducing organs arranged laterally of the shed, at least one weft thread being fed, prestored according to programme, to the shed through one of a number of tooth gaps provided in a reed for the passage of the warp threads, forming the weft threads into loops which are laid-in substantially parallel to a fabric beating edge, connecting the loops with one another within the width of the fabric between two adjacent warp threads by crossing the sides of a loop with respective sides of the other loop, while for the formation of a fabric edge from said at least one weft thread fed through the reed, said thread is looped with itself or held by means of at least one auxiliary thread.

2. The method according to claim 1, further including the steps of:

feeding the other one of the two weft threads to the shed from externally of one side of the warp threads, the two weft threads being laid into the shed in a same direction, and wherein the steps of forming the weft threads into loops and connecting the loops with one another within the width of the fabric comprise inserting, by means of a knitting tool, the loop formed from said at least one weft thread fed through the reed through the loop formed from said other weft thread and looping the two weft thread loops together.

3. The method according to claim 1, further including the steps of:

feeding the two weft threads to the shed each through one of two adjacent tooth gaps to the reed, and wherein the two crossed weft thread loops are formed into the shed in two opposite directions.

4. The method according to claim 1, wherein:

the step of laying comprises laying at least one further weft thread into the shed, each of the weft threads being fed through a respective tooth gap of the reed, and wherein the connected weft thread loops forming a middle region of the fabric are formed into the shed in a same direction and looped together or formed into the shed in two opposite directions, respectively.

5. The method according to claim 11, wherein:

the weft thread loops are connected together within the width of the fabric only in discrete sections of the fabric.

6. The method according to claim 1, wherein:

said at least one weft thread fed to the shed through a tooth gap of the reed is selected from several delivered threads, and each unselected thread is introduced together with a warp thread into the fabric.

7. A loom, particularly a tape loom, comprising:

a loom reed having tooth gaps, feed means for the programmed prestored feeding of at least two weft threads into a shed formed of warp threads passing through respective tooth gaps of the loop reed, said feed means being provided with at least two weft thread guides, at least one of said guides is arranged upstream of the loom reed for guiding one of said two weft threads through one of the loom reed gaps, at least two weft thread introducing organs arranged laterally of the shed in a plane of the fabric being woven and reciprocable across the shed in the machine rhythm such as to form said at least two weft threads into loops connected together within the width of the fabric, and at least one knitting tool reciprocable in the machine rhythm for forming an edge of the fabric from said one weft thread guided through the loom reed.

8. The loom according to claim 7, wherein:

the other one of said at least two weft thread guides is arranged on one side externally of the warp threads, and said at least two weft thread introducing organs are mounted on the same side as said other guide, said weft thread introducing organs being constructed in one piece and being formed, in the direction of the fabric being woven, by a first introducing portion, an end of which displays an open thread guide to form into loops said at least one weft thread guided through the loom reed, and by a second introducing portion, an end of which displays a closed thread guide to form into loops the weft thread fed through said other weft thread guide, the first introducing portion being shorter than the second introducing portion, and said knitting tool comprises a knitting needle arranged on the other side of the warp threads for inserting the loops formed by the first introducing portion into the loops formed by the second introducing portion and to form the edge of the fabric.

9. The loom according to claim 7, wherein:

said at least two weft thread guides of the feed means are arranged upstream of the loom reed, at least one of said weft thread introducing organs constructed as hook, and a respective one of said knitting tools being mounted on each side of the warp threads.

10. The loom according to claim 7, wherein:

said at least two weft thread guides of the feed means are arranged upstream of the loom reed, at least one of said weft thread introducing organs constructed as push rod, and a respective one of said knitting tools being mounted on each side of the warp threads.

11. The loom according to claim 7, wherein:

the feed means comprise a thread feeding organ arranged upstream of the loom reed for the selection of a weft thread and constructed from several raisable and lowerable thread guide as a device controllable according to pattern.

12. The loom according to claim 7, wherein:

at least one introducing organ, controllable in the machine rhythm, for at least one auxiliary thread is mounted on at least one side of the warp shed.

13. The fabric produced according to the method of claim 1.

* * * * *